US006174177B1

(12) United States Patent
Auclair

(10) Patent No.: US 6,174,177 B1
(45) Date of Patent: Jan. 16, 2001

(54) UNIVERSAL STRAND CLAMP

(75) Inventor: William T. Auclair, Winsted, CT (US)

(73) Assignee: Electric Motion Company, Inc., Winsted, CT (US)

( * ) Notice: Under 35 U.S.C. 154(b), the term of this patent shall be extended for 0 days.

(21) Appl. No.: 09/311,807

(22) Filed: May 13, 1999

(51) Int. Cl.[7] ..... H01R 4/66; H01R 4/30; H01R 4/38

(52) U.S. Cl. ..... 439/100; 439/801

(58) Field of Search ..... 439/100, 781, 439/782, 98, 806, 811, 564, 573, 801; 411/174

(56) References Cited

U.S. PATENT DOCUMENTS 1,420,790 * 6/1922 Varney ..... 403/391
3,610,659 * 10/1971 Gerarde ..... 280/169
5,055,056 10/1991 Auclair et al. ..... 439/98
5,816,866 * 10/1998 Langdon ..... 439/812

* cited by examiner

*Primary Examiner*—Brian Sircus
*Assistant Examiner*—Chandrika Prasad
(74) *Attorney, Agent, or Firm*—Alix, Yale & Ristas, LLP

(57) ABSTRACT

A strand clamp comprises a clamp assembly including first and second, substantially identical, clamp members. Grooves in the end portions of each clamp member form a pair of receptacles for receiving a ground wire and a strand. The shaft of a bolt extends through openings in the mid portion of each clamp member such that the bolt head and a nut mounted on the bolt shaft are positioned adjacent the outside surfaces of the clamp members. Torquing the nut clamps the ground wire and strand within the clamp assembly. A positioning tab extends inwardly from each end edge of each clamp member. The positioning tabs are laterally offset from each other to resist rotation of one clamp member relative to the other clamp member. The mid portion of each clamp member has an arcuate shape and is elastically compressible by the bolt and nut such that the mid portion imposes a spring force on the head of the bolt and the nut to resist loosening of the nut.

16 Claims, 2 Drawing Sheets

UNIVERSAL STRAND CLAMP

BACKGROUND OF THE INVENTION

Load carrying electrical cables generally induce an electrical charge on the messenger strands which are associated with such cables. For personnel and equipment safety reasons, the messenger strand must therefore be grounded at 4 to 5 locations over each mile of the cable run.

General purpose ground connectors have been utilized to provide an electrical connection between the strand and the ground conductor. However, these general purpose ground connectors have proved difficult to install and have not provided reliable connections due to the disparity in the outside diameters of the strand and the ground conductor.

Purpose-built strand connectors have also been used to electrically connect the ground conductor to the strand. Although these connectors provide a superior electrical connection between the strand and the ground conductor, they are sometimes difficult to install and are generally expensive to produce.

SUMMARY OF THE INVENTION

Briefly stated, the invention in a preferred form is a strand clamp for mounting a messenger strand to a ground wire. The strand clamp comprises a clamp assembly including first and second, substantially identical, clamp members. Each of the clamp members having oppositely disposed inside and outside surfaces where the inside surface of the first clamp member is positioned opposite to the inside surface of the second clamp member. A mid portion of each clamp member separates first and second side portions. First and second positioning tabs extend inwardly from the first and second end edges of each clamp member. The first positioning tab is laterally offset from the second positioning tab. The head of a bolt is positioned adjacent he outside surface of the first clamp member such that the shaft extends through openings in the mid portion of each clamp member. A nut is threadably displaceable on the threaded shaft of the bolt adjacent the outside surface of the second clamp member for clamping the first and second clamp members between the bolt head and the nut.

The first and second side portions each have a groove extending from the first end edge to the second end edge. The grooves of the first clamp member and the grooves of the second clamp member form a pair of receptacles for receiving the ground wire and the strand. Each of the receptacles has an arcuate engagement surface for clamping the ground wire and strand within the receptacle. The mid portion of each clamp member has an arcuate shape and is elastically compressible by the bolt and nut such that the mid portion imposes a spring force on the head of the bolt and the nut to resist loosening of the nut.

The strand clamp may also include a push nut which is mounted is on the shaft of the bolt adjacent the inside surface of the first clamp member to retain the bolt to the clamp assembly. The push nut has an opening and a plurality of tangs which extend obliquely into the opening. The diameter of the opening is greater than the diameter of the bolt shaft and the diameter defined by the inner tips of the tangs is smaller than the diameter of the bolt shaft. Inserting the bolt shaft into the opening causes the tangs to resiliently deform and apply a clamping force on the bolt shaft.

In a preferred embodiment, the opening of each clamp member has a substantially rectangular shape. In addition, the thread on opposite sides of the bolt shaft is removed to form a pair of oppositely disposed flattened surfaces and a pair of oppositely disposed threaded arcuate surfaces. The shape of the bolt shaft is complementary with the rectangular shape of the opening, thereby preventing rotation of the clamp members about the bolt shaft. Specifically, the pair of arcuate surfaces defines a distance Da and the pair of flattened surfaces define a distance Db, where Da>Db. The first pair of opposite surfaces of the opening define a distance Dc and the second pair of opposite surfaces define a distance Dd, wherein Dc>Dd, Dc>Da, and Da>Dd>Db.

An object of the invention is to provide a new and improved strand clamp for mounting the strand to a ground wire.

Another object of the invention is to provide a new and improved strand clamp which is less expensive to manufacture than conventional strand clamps.

A further object of the invention is to provide a new and improved strand clamp which has superior resistance to relative rotation between the two clamp members.

Other objects and advantages of the invention will become apparent from the drawings and the specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE PREFERRED EMBODIMENT

Figure 1:
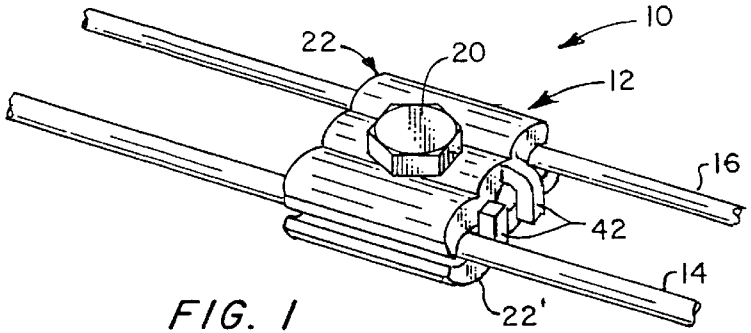
FIG. 1 is a perspective view of a first embodiment of a strand clamp in accordance with the present invention, illustrated clamping a ground wire to a strand.
Figure 7:
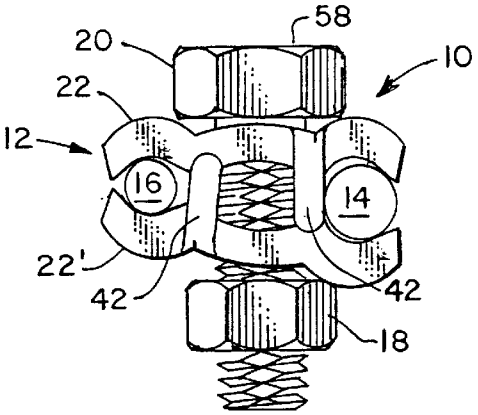
FIG. 7 is a front view of the strand clamp, ground wire and strand of FIG. 1.

With reference to the drawings wherein like numerals represent like parts throughout the several figures, a strand clamp in accordance with the present invention is generally designated by the numeral 10. The strand clamp 10 is comprised of a clamp assembly 12 which engages the strand 14 and ground wire 16 upon the application of torque to a clamp nut 18 which is threadably displaceable on a bolt 20, as shown in FIGS. 1 and 7.

Figure 5:
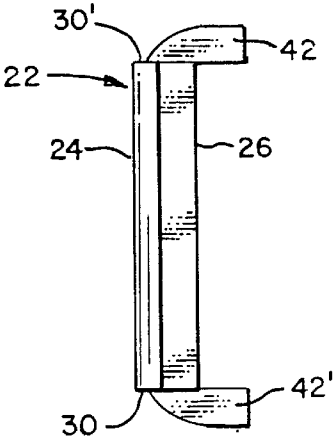
FIG. 5 is a side view, partly in phantom, of the clamp member of FIG. 4.
Figure 4:
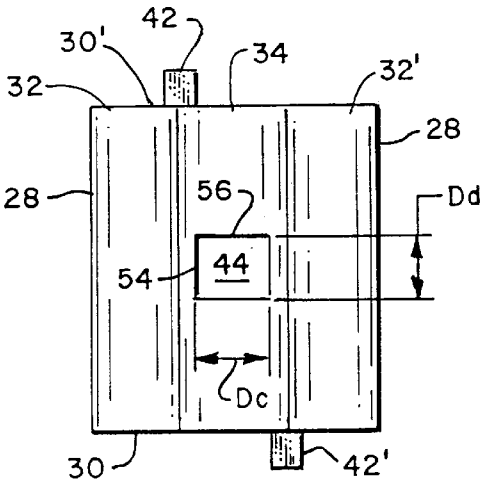
FIG. 4 is a front view of a clamp member of FIG. 1 viewed from the left thereof.
Figure 3:
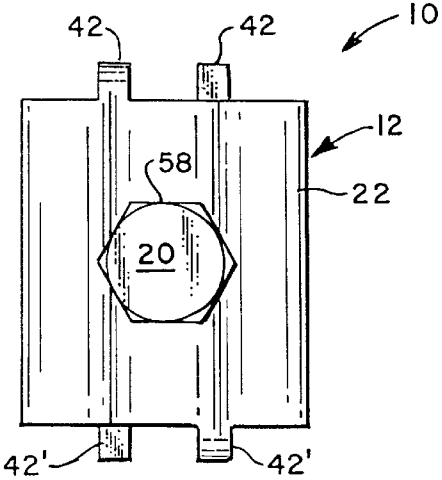
FIG. 3 is a top view of the strand clamp of FIG. 1.

The clamp assembly 12 is comprised of two cooperating, identical clamp members 22, 22'. With reference to FIGS. 4 and 5, each clamp member 22, 22' has outside and inside surfaces 24, 26, oppositely disposed side and end edges 28, 30, and oppositely disposed side portions 32, 32' which are separated by a mid portion 34. In a preferred embodiment, each clamp member 22, 22' has a rectangular shape where the length of the side edges 28 is greater than the length of the end edges 30, 30', thereby providing a longer surface for engaging the ground wire 16 and the strand 14. It should be appreciated that the lengths of the side and end edges 28, 30 may be equal or the length of the end edges may be greater than the length of the side edges without significantly effecting the performance of the clamp assembly. The inside surfaces 26 of the clamp members 22, 22' are disposed oppositely to each other when the clamp members 22, 22' are positioned to form the clamp assembly 12.

The inside surface 26 of the two side portions 32, 32' of each clamp member 22, 22' defines a groove 36 which extends from end edge 30 to end edge 30'. The grooves 36 in the first clamp member 22 are complementary with the grooves 36 in the second clamp member 22' and form a pair of receptacles 38 for receiving the ground wire 16 and the strand 14. The grooves 36 have an arcuate engagement surface 40 which provide increased surface-to-surface contact between the clamp members 22, 22' and the ground wire 16 and the strand 14 as compared to a flat engagement surface. Consequently, the clamp members 22, 22' firmly clamp the ground wire 16 and strand 14 within the receptacles 38 when the clamp nut is torqued.

A positioning tab 42 extends inwardly from each end edge of the clamp member. The first positioning tab 42 extends from a position adjacent the first side portion 32 and the second positioning tab 42' extends from a position adjacent the second side portion 32' and therefore are laterally offset from each other. When the clamp members 22, 22' are positioned to form the clamp assembly 12, the positioning tabs 42, 42' of each clamp member 22 are disposed adjacent the end edges 30 of the opposite clamp member 22' and thereby resist rotation of one of the clamp members 22 relative to the other clamp member 22'. The laterally offset locations of the positioning tabs 42, 42' provided a much greater resistance to such rotation than a single positioning tab on each end.

Figure 6:
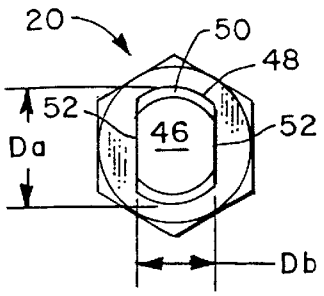
FIG. 6 is a bottom view of the bolt of the strand clamp of FIG. 1.

An opening 44 is provided in the mid portion 34 of each clamp member 22, 22' for receiving the shaft 46 of the bolt 20. In the first embodiment, the shaft 46 of the bolt 20 has been flattened by removing the thread 48 on oppositely disposed sides of the shaft 46 (FIGS. 2 and 6), producing a bolt shaft 46 that has a pair of oppositely disposed threaded arcuate surfaces 50 and a pair of oppositely disposed flat surfaces 52. As shown in FIG. 6, the distance Da between the arcuate surfaces 50 is greater than the distance Db between the flat surfaces 52. The opening 44 in each clamp member 22, 22' has a rectangular shape which is complementary to the flattened-shape of the bolt shaft 46. That is, the distance Dc between one pair of the opposite edges 54 of the opening 44 is greater than the distance Da between the arcuate surfaces 50 of the bolt shaft 46 and the distance Dd between the other pair of the opposite edges 56 of the opening 44 is greater than the distance Db between the flat surfaces 52 of the bolt shaft 46 but less than the distance Da between the arcuate surfaces 50 of the bolt shaft 46. As a consequence, the bolt shaft 46 resists rotation of one of the clamp members 22 relative to the other clamp member 22'.

As shown in FIG. 7, the ground wire 16 generally has an outside diameter which is smaller than the outside diameter of the strand 14. When the ground wire 16 and strand 14 are mounted within the clamp assembly, the difference in the outside diameters causes the second clamp member 22' to be cocked relative to the first clamp member 22. To ensure that the positioning tabs 42, 42' resist relative rotation between the clamp members 22, 22', the minimum length of the positioning tabs 42, 42' must be selected such that the positioning tab 42 adjacent the strand 14 engages the end edge 30 of the opposite clamp member 22.

Figure 2:
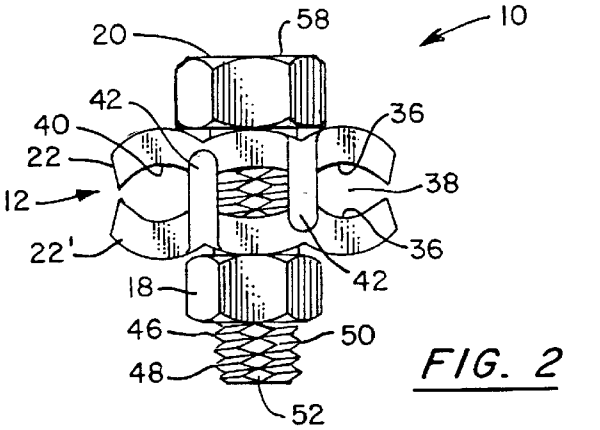
FIG. 2 is a side view of the strand clamp of FIG. 1.

The mid portion 34 of each clamp member 22, 22' has an arcuate shape (FIGS. 2 and 7). When the clamp nut 18 is torqued, this arcuate shape allows the mid portion 34 to be elastically compressed, imposing a spring force on the head 58 of the bolt 20 and the clamp nut 18. This spring force ensures that the outside surfaces 24 of the two clamp members 22, 22' are in frictional engagement with the bolt head 58 and clamp nut 18. This frictional engagement resists loosening of the clamp nut 18 that might have resulted from temperature changes, vibration, or movement of the ground wire 16 or strand 14.

Figure 8:
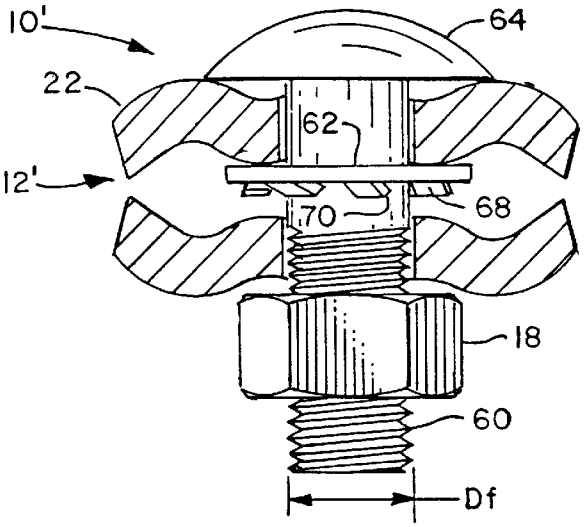
FIG. 8 is a side view of a second embodiment of a strand clamp in accordance with the present invention.
Figure 10:
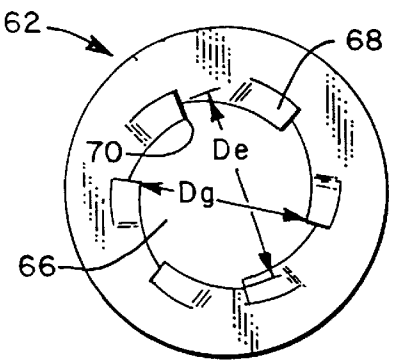
FIG. 10 is a front view of the push nut of FIG. 8.

In the embodiment 10' of FIG. 8, the bolt shaft 60 is inserted through the opening 44 in the first clamp member 22 and a push nut 62. The push nut 62 retains the bolt 64 within the first clamp member 22. With reference to FIG. 10, the push nut 62 is washer-shaped, having a substantially circular outer edge and an inner opening 66 for receiving the bolt shaft 60. The opening 66 has a diameter De which is greater than the outside diameter Df of the bolt shaft 60. A plurality of tangs 68 extend obliquely into the inner opening 66. The inner tips 70 of the tangs 68 define an inside diameter Dg which is smaller than the outside diameter Df of the bolt shaft 60. The material of construction and the thickness of the push nut 62 are selected such that the tangs 68 will resiliently deform to allow the bolt shaft 60 to be pushed through the inner opening 66. In a preferred embodiment, the push nut 62 is composed of steel and has a thickness of 0.015 inches. The inner tips 70 of the tangs 68 frictionally engage the bolt shaft 60 to retain the bolt 64 to the first clamp member 22.

Figure 9:
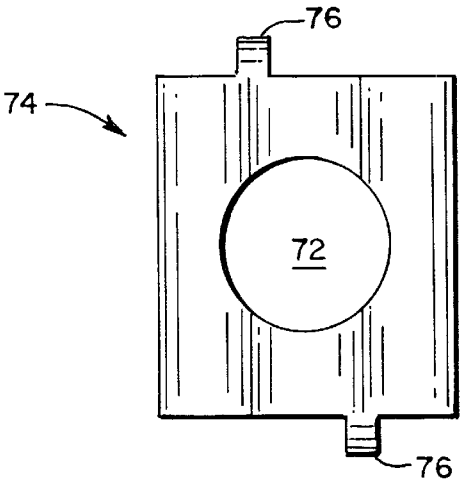
FIG. 9 is a front view of an alternate embodiment of the clamp member of FIG. 4 viewed from the left thereof.

As shown in FIG. 9, the opening 72 in the clamp member 74 may have a circular shape instead of a rectangular shape. A strand clamp utilizing clamp members 74 having circular openings 72 relies solely on the positioning tabs 76 for preventing rotation of one clamp member 74 relative to the other clamp member 74.

It should be appreciated that utilizing identical clamp members 22, 22' to form the clamp assembly 12 reduces the manufacturing costs since the same tooling is used to manufacture both the first and second clamp members 22, 22' and since a single production run is utilized to manufacture both parts. It should also be appreciated that the clamp members 22, 22' of the subject invention may be manufactured in a simple stamping process from tin plated brass plate, resulting in additional manufacturing cost savings.

It should be further appreciated that the design of the subject strand clamp 10 provides for flexibility of use. As explained above, the strand clamp 10 is generally used to clamp two electrical conductors, where the diameter of one conductor (strand) is greater than the diameter of the other conductor (ground wire). However, the strand clamp 10 will also clamp two conductors of equal diameter. Therefore, the strand clamp 10 may be used to clamp one strand to another strand or to clamp one wire to another wire. Consequently, a worker only has to carry the strand clamp 10 instead of three different clamps.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A strand clamp for mounting a ground wire to a messenger strand comprising:

a clamp assembly including first and second, substantially identical, clamp members, each of the clamp members having oppositely disposed inside and outside surfaces, oppositely disposed first and second laterally extending end edges, first and second longitudinally extending side portions, a longitudinally extending mid portion disposed intermediate the first and second side portions, and first and second laterally offset positioning tabs, the first and second end edges each defining a substantially planar surface, the first and second positioning tabs extending longitudinally beyond the planar surfaces of the first and second end edges, respectively, and extending inwardly beyond the inside surface of the clamp member, the mid portion defining an opening, the inside surface of the first clamp member being disposed oppositely to the inside surface of the second clamp member, the first and second positioning tabs of the first clamp member being positionable adjacent the planar surfaces of the first and second end edges of the second clamp member and the first and second positioning tabs of the second clamp member being positionable adjacent the planar surfaces of the first and second edges of the first clamp member;

a bolt having a bolt head disposed adjacent the outside surface of the first clamp member and a shaft extending through the openings of the first and second clamp members, respectively, at least a portion of the shaft having a threaded surface; and a nut disposed adjacent the outside surface of the second clamp member, the nut being threadably displaceable on the bolt for clamping the first and second clamp members between the bolt head and the nut.

2. The strand clamp of claim 1 wherein the first and second side portions each have a groove extending from the first end edge to the second end edge, the grooves of the first clamp member being complementary with the grooves of the second clamp member and defining a pair of receptacles for receiving the ground wire and the strand.

3. The strand clamp of claim 2 wherein each of the receptacles has an arcuate engagement surface.

4. The strand clamp of claim 1 wherein the mid portion of each clamp member has an arcuate shape, the mid portion being elastically compressible by the bolt and nut whereby the mid portion imposes a spring force on the head of the bolt and the nut.

5. The strand clamp of claim 1 wherein the opening of each clamp member has a substantially rectangular shape and the shaft of the bolt has a pair of oppositely disposed flattened surfaces and a pair of oppositely disposed threaded arcuate surfaces.

6. The strand clamp of claim 5 wherein the pair of arcuate surfaces defines a distance Da and the pair of flattened surfaces define a distance Db, wherein Da>Db.

7. The strand clamp of claim 6 wherein the opening has first and second pairs of opposite flat surfaces, the first pair of flat surfaces defining a distance of Dc and the second pair of flat surfaces defining a distance Dd, wherein Dc>Dd, Dc>Da, and Da>Dd>Db.

8. The strand clamp of claim 1 further comprising a push nut mounted on the shaft of the bolt adjacent the inside surface of the first clamp member.

9. The strand clamp of claim 8 wherein the push nut defines an opening and includes a plurality of tangs extending obliquely into the opening to an inner tip, the opening having a diameter De and the inner tips of the tangs defining a diameter Dg, wherein De>Dg.

10. The strand clamp of claim 9 wherein the shaft of the bolt has an outer diameter Da, wherein De>Da>Dg.

11. A strand clamp for mounting a ground wire to a strand comprising:

a clamp assembly including first and second clamp members, each of the clamp members having oppositely disposed inside and outside surfaces, first and second side portions, and a mid portion disposed intermediate the first and second side portions, the mid portion of each clamp member having an arcuate shape, the inside surface of the first clamp member being disposed oppositely to the inside surface of the second clamp member, the mid portion defining an opening having a substantially rectangular shape;

a bolt having a bolt head disposed adjacent the outside surface of the first clamp member and a shaft extending through the openings of the first and second clamp members, respectively, the shaft having a pair of oppositely disposed flattened surfaces and a pair of oppositely disposed threaded arcuate surfaces, the pair of flattened surfaces and the pair of arcuate surfaces defining a shape which is complementary to the rectangular shape of the openings of the clamp assembly; and a nut disposed adjacent the outside surface of the second clamp member, the nut being threadably displaceable on the bolt for clamping the first and second clamp members between the bolt head and the nut;

wherein the mid portion of each clamp member is elastically compressible by the bolt and nut whereby the mid portion imposes a spring force on the head of the bolt and the nut.

12. The strand clamp of claim 11 wherein the opening has first and second pairs of oppositely disposed surfaces, the pair of arcuate surfaces of the bolt defining a distance Da, the pair of flattened surfaces of the bolt defining a distance Db, the first pair of surfaces of the opening defining a distance of Dc and the second pair of surfaces of the opening defining a distance Dd, wherein Dc>Da>Dd>Db.

13. The strand clamp of claim 11 wherein the first and second side portions each have a groove extending from the first end edge to the second end edge, the grooves of the first clamp member being complementary with the grooves of the second clamp member and defining a pair of receptacles for receiving the ground wire and the strand.

14. The strand clamp of claim 11 wherein each of the clamp members further comprises first and second end edges and first and second positioning tabs extending inwardly from the first and second end edges, the first positioning tab being laterally offset from the second positioning tab, the positioning tabs of the first clamp member being disposed adjacent the end edges of the second clamp member and the positioning tabs of the second clamp member being disposed adjacent the end edges of the first clamp member.

15. A clamp for mounting a first wire to a second wire comprising:

a clamp assembly including first and second clamp members, each of the clamp members having oppositely disposed inside and outside surfaces, oppositely disposed first and second laterally extending end edges, first and second longitudinally extending side portions, a longitudinally extending mid portion disposed intermediate the first and second side portions, and first and second laterally offset positioning tabs, the first and second side edges each defining a substantially planar surface, the first and second positioning tabs extending longitudinally beyond the planar surfaces of the first and second end edges, respectively, and extending inwardly beyond the inside surface of the clamp member, each clamp member defining an opening, the inside surface of the first clamp member being disposed oppositely to the inside surface of the second clamp member, the first and second positioning tabs of the first clamp member being positionable adjacent the planar surfaces of the first and second end edges of the second clamp member and the first and second positioning tabs of the second clamp member being positionable adjacent the planar surfaces of the first and second edges of the first clamp member;

a bolt having a bolt head disposed adjacent the outside surface of the first clamp member and a shaft extending through the openings of the first and second clamp members, respectively, at least a portion of the shaft having a threaded surface;

a nut disposed adjacent the outside surface of the second clamp member, the nut being threadably displaceable on the bolt for clamping the first and second clamp members between the bolt head and the nut; and a push nut mounted on the shaft of the bolt adjacent the inside surface of the first clamp member;

wherein the mid portion of each clamp member is elastically compressible by the bolt and nut whereby the mid portion imposes a spring force on the head of the bolt and the nut.

16. The strand clamp of claim 15 wherein the shaft of the bolt has an outer diameter Da and the push nut defines an opening and includes a plurality of tangs extending into the opening to an inner tip, the opening having a diameter De and the inner tips of the tangs defining a diameter Dg, wherein De>Da>Dg.

* * * * *